US011167899B2

(12) United States Patent
Tomioka

(10) Patent No.: US 11,167,899 B2
(45) Date of Patent: Nov. 9, 2021

(54) TOILET PAPER ROLL PACKAGE

(71) Applicant: Daio Paper Corporation, Ehime (JP)

(72) Inventor: Noritada Tomioka, Shizuoka (JP)

(73) Assignee: Daio Paper Corporation, Ehime (JP)

( * ) Notice: Subject to any disclaimer, the term of this patent is extended or adjusted under 35 U.S.C. 154(b) by 0 days.

(21) Appl. No.: 16/958,296

(22) PCT Filed: Dec. 11, 2018

(86) PCT No.: PCT/JP2018/045437
§ 371 (c)(1),
(2) Date: Jun. 26, 2020

(87) PCT Pub. No.: WO2019/131102
PCT Pub. Date: Jul. 4, 2019

(65) Prior Publication Data

US 2021/0053735 A1 Feb. 25, 2021

(30) Foreign Application Priority Data

Dec. 27, 2017 (JP) ..... JP2017-251488

(51) Int. Cl.
*B65D 71/06* (2006.01)
*B65D 79/00* (2006.01)

(52) U.S. Cl.
CPC ..... *B65D 71/063* (2013.01); *B65D 79/00* (2013.01); *B65D 2571/0045* (2013.01); *B65D 2571/00574* (2013.01)

(58) Field of Classification Search
CPC ..... B65D 71/06; B65D 71/063; B65D 75/12; B65D 75/52; B65D 75/56; B65D 75/566; B65D 75/58; B65D 75/5827; B65D 79/00; B65D 85/00; B65D 2571/0045; B65D 2571/00574
USPC ..... 206/391–394, 494, 497
See application file for complete search history.

(56) References Cited

U.S. PATENT DOCUMENTS 4,765,474 A * 8/1988 James ..... B65D 75/12 206/391
7,971,717 B2 * 7/2011 Eilert ..... B65D 75/566 206/391
8,256,616 B2 * 9/2012 Eilert ..... B65D 75/5827 206/391
2007/0084741 A1 * 4/2007 Dall'Omo ..... B65D 75/52 206/391
2008/0078685 A1 * 4/2008 Patterson ..... B65D 5/4204 206/391
2011/0048994 A1 * 3/2011 Eilert ..... B65D 75/56 206/391

(Continued)

FOREIGN PATENT DOCUMENTS

JP U2591646 Y2 3/1999
JP 2000-302166 A 10/2000

(Continued)

*Primary Examiner* — Bryon P Gehman
(74) *Attorney, Agent, or Firm* — Renner, Kenner; Arthur M. Reginelli

(57) ABSTRACT

A toilet paper roll package including toilet paper rolls arranged in two rows with the peripheral surfaces abutting between the upper sealing portion and the lower sealing portion in gusset packaging. The upper sealing portion and the lower sealing portion are configured to be easily unsealed to remove the toilet paper rolls.

2 Claims, 4 Drawing Sheets

(56) References Cited

U.S. PATENT DOCUMENTS

2012/0205272 A1* 8/2012 Heilman ..... B65D 75/38
206/391

FOREIGN PATENT DOCUMENTS

| | | | | |
|---|---|---|---|---|
| JP | 2001-294264 | A | | 10/2001 |
| JP | 2004-269009 | A | | 9/2004 |
| JP | 2005153959 | A | * | 6/2005 |
| JP | 2012121592 | A | * | 6/2012 |

* cited by examiner (A)

(B)

TOILET PAPER ROLL PACKAGE

TECHNICAL FIELD

The present invention relates to a toilet paper roll package in which a plurality of toilet paper rolls is film-wrapped.

BACKGROUND ART

Toilet paper roll with long toilet paper rolled is used in bathrooms integrated with toilets, and is often used in kitchens and living rooms as a substitute for versatile pop-up tissue paper products and kitchen paper rolls.

On the other hand, a plurality of toilet paper rolls is collectively wrapped with an exterior film such that a plurality of toilet paper rolls can be stored after purchase.

On the other hand, many of toilet paper roll packages are film-wrapped with multiple toilet paper rolls as they are, but such toilet paper rolls film-wrapped as they are have a problem that unused toilet paper rolls remaining after unsealing a package may be exposed to water from a shower or the like when stored in a bathroom integrated with a toilet, and also that it is large for storing in a kitchen or a living room, and it does not look good to take out and store each toilet paper.

Therefore, in the package that put together a plurality of toilet paper rolls, toilet paper rolls are individually wrapped and then collectively wrapped for commercialization so as to be easily used in a bathroom, kitchen, living room, and the like.

However, these products have problems that, since toilet paper rolls are double-wrapped, it takes time to unseal and is difficult to take out.

CITATION LIST

Patent Literature

Patent Literature 1: JP 2001-294264A

Patent Literature 2: Registered Utility Model No. 2591646

SUMMARY OF INVENTION

Technical Problem

Therefore, a main object of the present invention is to make it easy to unseal a toilet paper roll package in which individually wrapped toilet paper rolls are further collectively wrapped, and to take out individual toilet paper rolls.

Solution to Problem

Means for solving the above problems are as follows.

In the first means, in a toilet paper roll package in which a plurality of toilet paper rolls individually wrapped with a resin film is gusseted with an exterior film, the toilet paper rolls are arranged in two rows with peripheral surfaces abutting between an upper sealing portion and a lower sealing portion in gusset packaging, the upper sealing portion and the lower sealing portion are located at a position facing the peripheral surfaces of the toilet paper rolls, in a range of a surface of the exterior film facing an end surface of the toilet paper roll and a surface extending from this surface to the upper sealing portion, an unsealing portion formed by a perforation is formed, this unsealing portion includes an unsealing start portion with U-shaped or substantially V-shaped perforations arranged such that an upper sealing portion side is a top side, and a belt-shaped outlet forming portion that is wider than the unsealing start portion and is formed by a pair of perforations that extend from each of both ends of the unsealing start portion toward the lower sealing portion, the unsealing start portion is closer to the upper sealing portion than a position adjacent to a pair of toilet paper rolls located closest to the upper sealing portion, and has an unsealing start auxiliary perforation extending from the U-shaped or substantially V-shaped top to the upper sealing side, and each perforation forming the outlet forming portion is located on a toilet paper roll group of each row arranged in two rows, and has a width of 0.5 to 1.2 times a toilet paper roll diameter.

In the second means, in a toilet paper roll package in which a plurality of toilet paper rolls individually wrapped with a resin film is gusseted with an exterior film, the toilet paper rolls are arranged in two rows with peripheral surfaces abutting between an upper sealing portion and a lower sealing portion in gusset packaging, the upper sealing portion and the lower sealing portion are located at a position facing the peripheral surfaces of the toilet paper rolls, in a range of a surface of the exterior film facing an end surface of the toilet paper roll and a surface extending from this surface to the upper sealing portion, an unsealing portion formed by a perforation is formed, this unsealing portion includes an unsealing start portion where perforations are arranged in a trapezoidal top shape such that an upper sealing portion side is a top side, and a belt-shaped outlet forming section wider than the unsealing start portion and is formed by a pair of perforations that extend from each of both ends of the unsealing start portion toward the lower sealing portion, the unsealing start portion is closer to the upper sealing portion than a position adjacent to a pair of toilet paper rolls located closest to the upper sealing portion, and has a pair of unsealing start auxiliary perforations extending from each upper end of the trapezoidal top portion to the upper sealing side, and each perforation forming an outlet forming portion is located on a toilet paper roll group of each row arranged in two rows, and has a width of 0.5 to 1.2 times the toilet paper roll diameter.

Advantageous Effects of Invention

The present invention described above provides a toilet paper roll package in which individually wrapped toilet paper rolls are further collectively wrapped and which is easily unsealed and makes it easy to take out individual toilet paper rolls.

DESCRIPTION OF EMBODIMENTS

Figure 1:
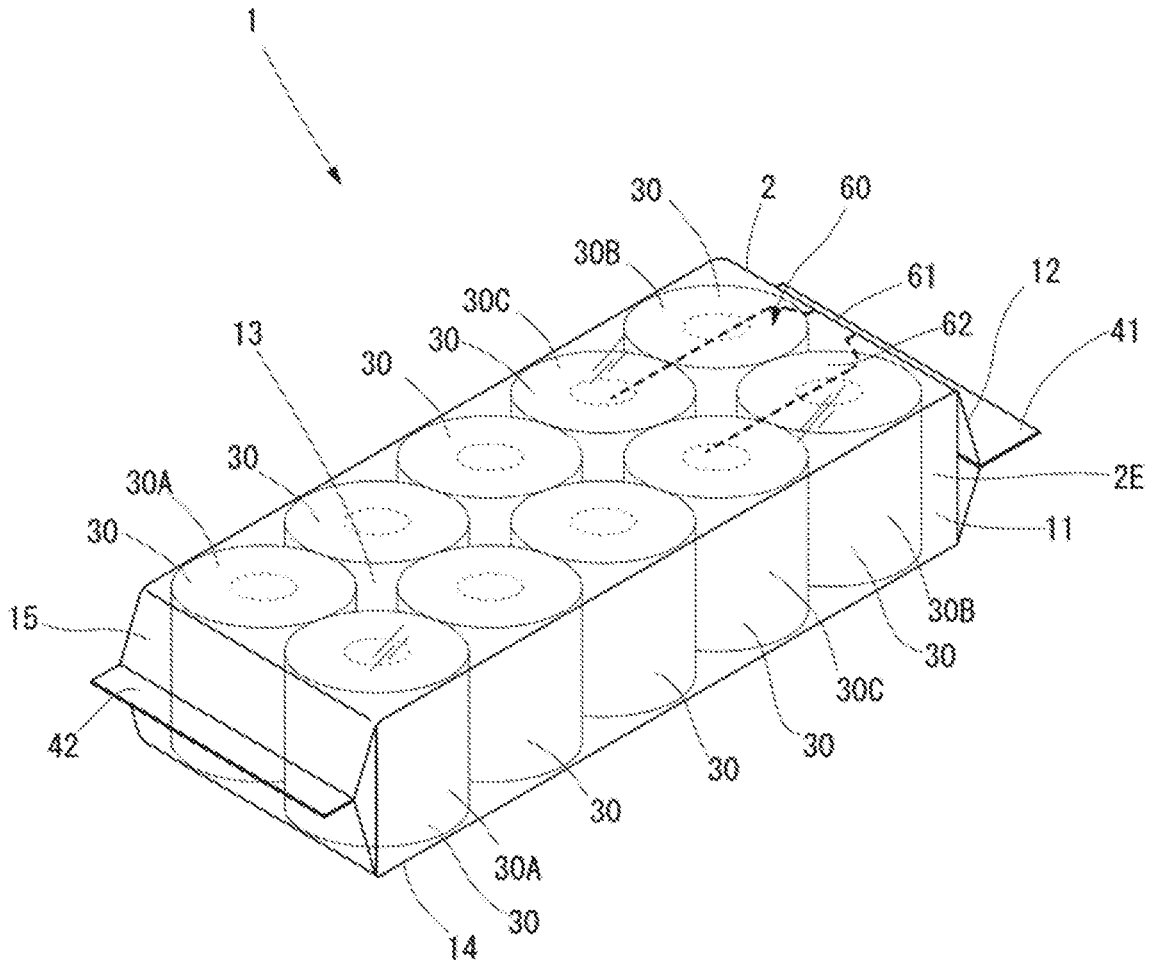
FIG. 1 is a perspective view of a package according to an embodiment.
Figure 2:
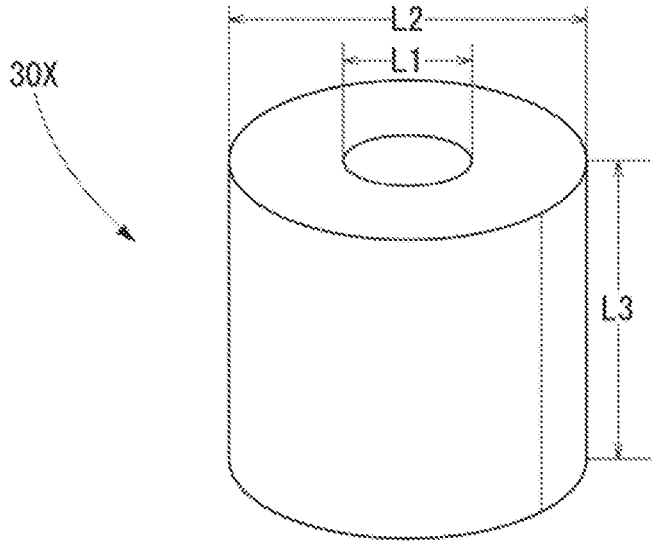
FIG. 2 is a view of a toilet paper roll according to the embodiment.
Figure 2:
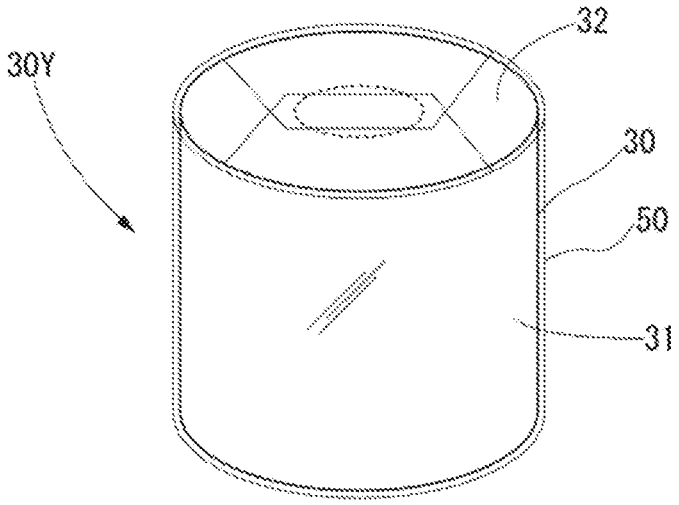
Figure 3:
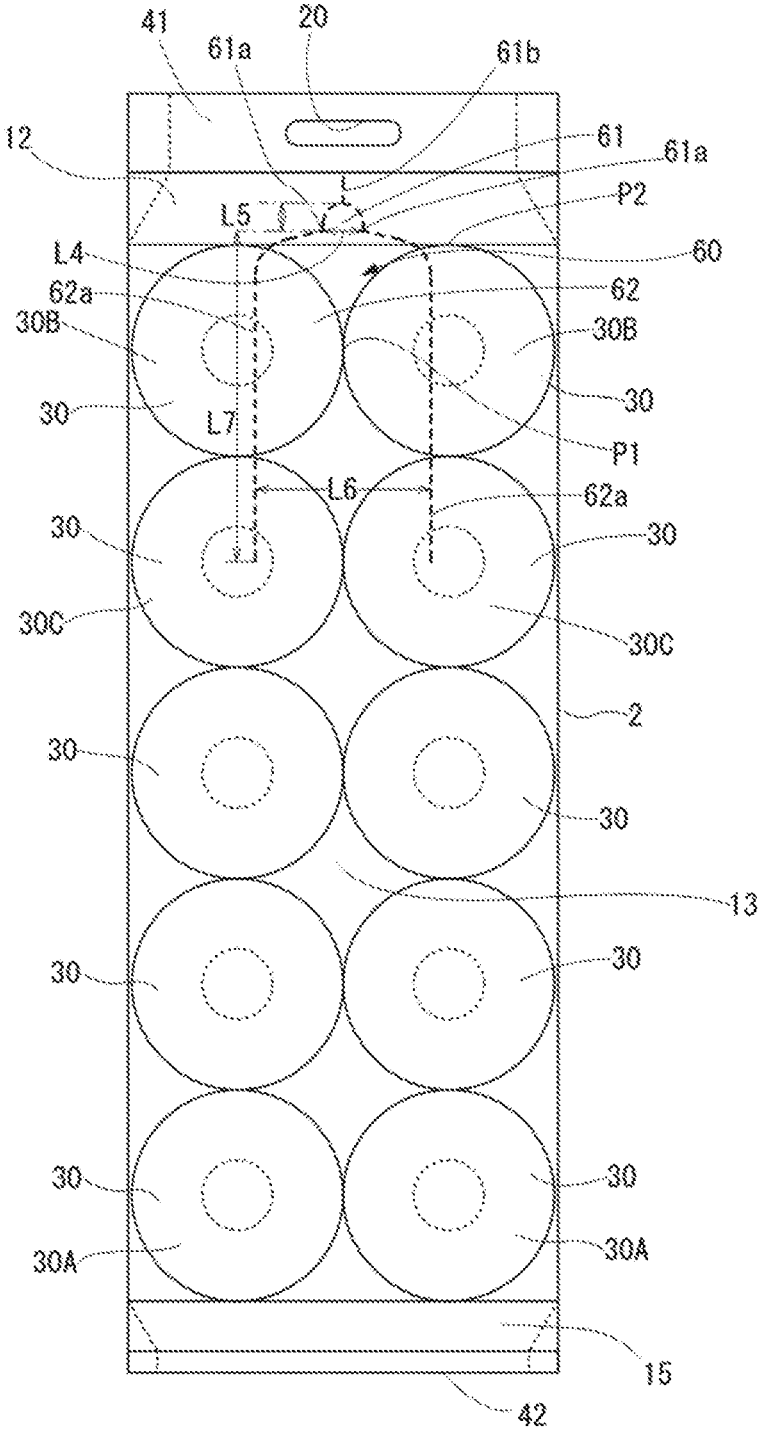
FIG. 3 is a front view for explaining an unsealing portion according to a first embodiment.

Next, the embodiments of a package of the present invention will be described in detail with reference to FIGS. 1 to 4.

First Embodiment

A toilet paper roll package 1 according to the present embodiment is a toilet paper roll package (hereinafter, simply referred to as a package) that is gusseted with an exterior film 2.

The package 1 can be manufactured, for example, by opening a lower opening of gusset packaging in which an upper sealing portion 41 is formed by sealing an upper portion in a state where the side portions 2E and 2E of a barrel shaped exterior film are folded inward and flattened, inserting a toilet paper roll 30, and then sealing a lower portion to form a lower sealing portion 42 that seals the opening.

Further, the package 1 has gusset portions 11 and 11 formed by opening the side portions 2E and 2E of the exterior film folded in a flat state and has surfaces 12, 13, 14, and 15 connected to the gusset portions in a state where the toilet paper roll 30 is packed. That is, among the surfaces connected to the gusset portions 11, the surface connected to the upper sealing portion 41 is the top surface 12, and the surface connected to the lower sealing portion 42 is the bottom surface 15. Further, the second surface connected to the top surface 12 and the bottom surface 15 and each of the gusset portions 11 and 11 is the front surface 13 and the back surface 14. However, the front surface 13 and the back surface 14 are relative, and it is not limited which surface is the front surface.

The upper sealing portion 41 and the lower sealing portion 42 are formed by a known sealing technique such as heat sealing or ultrasonic welding. Preferably, those are formed by heat sealing.

In the upper sealing portion 41 of the package 1, it is desirable to form a known finger hole 20 in the upper sealing portion 41 so that the package 1 can be easily carried.

In this package 1, characteristically, the toilet paper rolls 30 are arranged in two rows with the peripheral surfaces abutting between the upper sealing portion 41 and the lower sealing portion 42 in gusset packaging, and the upper sealing portion 41 and the lower sealing portion 42 are located at a position facing the peripheral surfaces 31 of the toilet paper rolls 30. That is, the package 1 has two rows of the toilet paper rolls 30 from the upper sealing portion 41 toward the lower sealing portion 42, and the end surface 32 of the toilet paper roll 30 is arranged so as to face the front surface 13 and the back surface 14 of the package 1. The preferred number of toilet paper rolls to be wrapped in the package 1 is four rolls×two rows for a total of eight rolls, five rolls×two rows for a total of ten rolls, and six rolls×two rows for a total of twelve rolls. In particular, it is suitable for the case of five rolls×two rows for a total of ten rolls as in the illustrated example.

Many of the gusseted toilet paper roll packages (hereinafter referred to as conventional package) are arranged in a plurality of vertical stacks such that the end surfaces of the toilet paper rolls face the upper sealing portions and lower sealing portions of the included toilet paper rolls. This is because, particularly in products where toilet paper rolls are packaged as they are, after unsealing the vicinity of the upper sealing portion to take out a part, an opening is easily closed while remaining toilet paper rolls are left in the exterior film to store in a sanitary manner. However, in the case of the conventional package having this arrangement, it is necessary to sequentially take out the upper toilet paper roll in order to take out the lowermost toilet paper roll. The package 1 is a double package in which the toilet paper rolls 30 as an inclusion are individually wrapped with a resin film 50, such that after unsealing the exterior film 2, even if all of the toilet paper rolls 30 are taken out of the exterior film 2, they can be stored in a sanitary manner. It is desirable that all of them be taken out of the exterior film 2 because they can be used quickly. Obviously a part may be left in the exterior film 2. However, also in this case, since the toilet paper roll 30 as an inclusion is individually wrapped with the resin film 50, it is not necessary to close the opening. Therefore, in the package 1 which is a double package in which the toilet paper rolls 30 as an inclusion are individually wrapped with the resin film 50, it is desirable to make the take-out property from the exterior film 2 more excellent. In this case, the end surfaces 32 of the toilet paper roll 30 are arranged in the up-down direction, and are arranged such that the end surfaces 32 of the toilet paper roll 30 faces the front surface 13 and the back surface 14 of the package 1 rather than the arrangement of the conventional package arranged in a plurality of vertical stacks.

It is desirable to adopt the arrangement as in the package 1 that makes possible to easily reach all the toilet paper rolls 30 when used by the user, by entirely flattening the surface formed by the end surfaces 32 of the toilet paper roll 30 by arranging in this way.

In the case where, in the package 1, the toilet paper rolls 30 are arranged in two rows with the peripheral surfaces abutting between the upper sealing portion 41 and the lower sealing portion 42 as in the present embodiment, and the upper sealing portion 41 and the lower sealing portion 42 are located at a position facing the peripheral surfaces 31 of the toilet paper rolls 30, the toilet paper roll packages may be multi-stacked during transportation or at stores, and also there is a case where the peripheral surface side of the toilet paper roll 30A closest to the lower sealing portion is placed on the bottom. In such a case, in order to make the toilet paper roll 30 hard to be crushed, it is desirable that the enclosed toilet paper rolls 30 be slightly hard-wound and have the following shape.

That is, desirably the toilet paper roll 30 has a basis weight per sheet of 11 to 25 g/m$^2$, and single-layer or multilayer toilet paper with a single sheet thickness of 70 to 150 μm is wound around a core having a diameter L1 of 36 to 45 mm and a length of 20 to 63 m such that the toilet paper roll diameter L2 becomes 100 to 120 mm. Such rolled toilet paper roll 30 has sufficiently high strength against crushing both in the direction between the end surfaces and in the circumferential direction when being individually packaged, and it is particularly suitable in the arrangement form of the toilet paper rolls in the package 1. Further, the shape of the toilet paper roll 30 desirably has a width L3 of 100 to 110 mm. The width L3 of the toilet paper roll 30 is shorter than the width of a general toilet paper roll. By making the toilet paper roll shape a little narrower, in the above arrangement, the stability is improved when the package 1 is placed such that the front surface 13 and the back surface 14 of the package 1 are located in the up-down direction, it becomes easy to take out from the opening by the unsealing portion 60 described later.

It is desirable that the exterior film 2 have a thickness of 40 to 80 μm. The thickness of the exterior film 2 is larger than that of the film used in many conventional packages in which a plurality of vertically stacked toilet paper rolls are included such that the end surfaces of the toilet paper roll face the upper and lower sealing portions. By making the exterior film 2 thicker, the strength of the whole package can be increased, and the toilet paper roll 30 is less likely to be crushed. Further, particularly when the finger hole 20 is formed in the upper sealing portion 41, in the case of the arrangement of the toilet paper rolls 30 in the package 1, when the package 1 is lifted by using the finger hole 20 such that the upper sealing portion 41 is located above, two rows of the toilet paper rolls 30 formed by abutting the peripheral surfaces are continuous in the up-down direction. In this case, if the exterior film 2 is thin and easily stretched, and if the number of the toilet paper rolls 30 exceeds approximately six, and the number of the toilet paper rolls 30 in each row exceeds three, the alignment in the exterior film 2 is likely to be broken. The above-mentioned thickness of the exterior film 2 can secure enough strength to maintain the arrangement state even when five or more sheets of toilet paper are arranged in each row. The melting point of the exterior film 2 is desirably 150° C. or less for forming the respective sealing portions. Specifically, a polypropylene resin film and a polyethylene resin film are desirable in terms of cost and unsealability. In addition, the lower the melting point of the packaging film, the lower the temperature at which the heat-sealing treatment can be performed. Therefore, it is preferable in forming the upper sealing portion 41 and the lower sealing portion 42. However, if the melting point is excessively low, there is a high possibility that the film is damaged or holes are formed due to friction or the like. Therefore, the practical lower limit is 80° C. Examples of the polyethylene resin film include a linear low density polyethylene film (LLDPE), a low density polyethylene film (LDPE), and a medium density polyethylene film (MDPE). Among them, in the present invention, a linear low-density polyethylene film layer (LLDPE) having a density of about 0.90 to 1.00 g/cm$^3$ and a melting point of 80 to 150° C. is particularly suitable from the viewpoint of heat sealability and cost. Further, when an odorous toilet paper roll such as a scented toilet paper roll is packaged as the toilet paper roll 30, an ethylene vinyl alcohol copolymer resin film or a polyethylene terephthalate resin film may be used. Furthermore, a multilayer resin film may be used in which a polyethylene resin film or a polypropylene resin film is laminated on one surface or both surfaces of ethylene vinyl alcohol copolymer resin film, or polyethylene terephthalate resin film to enhance the heat-sealing property.

The package 1 has a characteristic unsealing portion 60 formed by perforations on the surface of the exterior film 2 facing the end surfaces 32 of the toilet paper roll 30 and a range from this surface to a surface to the upper sealing portion, that is a range including at least one surface of the front surface 13 and the back surface 14 to a top surface extending to the surface. The enclosed toilet paper rolls 30 can be easily taken out from the opening of the exterior film 2 formed by unsealing the unsealing portion 60.

This unsealing portion 60 has an unsealing start portion 61 with U-shaped or substantially V-shaped perforations arranged such that the upper sealing side is the top side and a belt-shaped outlet forming portion 62 that is wider than the unsealing start portion 61 by a pair of perforations 62*a* and 62*a* that are continuous with both ends 61*a* of the unsealing start portion 61 and that extend toward the lower sealing portion 42. Note that it is desirable that the outlet forming portions 62 be configured so as to gradually expand from the end 61*a* of the unsealing start portion.

The cut tie ratio (cut:tie) of the perforations 62*a* is 2:1 to 1:3. The length of the cut portion is preferably 1 to 2 mm.

The unsealing start portion 61 is a portion for facilitating the unsealing of the unsealing portion 60 by pushing in and inserting a finger. In particular, the unsealing start portion 60 of the package 1 works well when the exterior film 2 has the thickness as described above. The width L4 and the length L5 of the unsealing start portion 61 need only be large enough to allow a finger to be inserted. However, if the width L4 and the length L5 are excessively wide, it becomes difficult to unseal easily by pushing. The specific width L4 is desirably 20 to 50 mm. Further, it is desirable that the length L5 be 15 to 30 mm in the arrangement direction of the toilet paper rolls.

Further, the unsealing start portion 61 has an unsealing start auxiliary perforation 61*b* extending from the U-shaped or substantially V-shaped vertex to the upper sealing side. When this range surrounded by the unsealing start auxiliary perforation 61*b* in the U-shape or the substantially V-shape is pushed by a finger, the perforation is smoothly opened. In particular, the presence of the unsealing start auxiliary perforation 61*b* makes it possible to smoothly unseal even the thick exterior film 2. The length of the unsealing start auxiliary perforation 61*b* is desirably 10 to 20 mm. If the length is less than 10 mm or more than 20 mm, the effect of weakening the pushing force is reduced.

The unsealing start portion 61 is located at the central portion of the two toilet paper roll rows, and in particular, is closer to the upper sealing portion than the adjacent position P1 of a pair of the toilet paper rolls 30B and 30B closest to the upper sealing portion. Preferably, a part thereof is located in a range from a position adjacent to the toilet paper roll up to 0.5 times the diameter L2 of each of the pair of toilet paper rolls to 0.5 times the diameter L2 of each toilet paper roll+0.5 times the width L3 of each toilet paper roll. In this position, the presence of the toilet paper roll 30 does not make it difficult to push the unsealing start portion 61 with a finger. In addition, in particular, it is desirable that the vertex position of the above U or V shape be located at a position within the width L3 of the toilet paper roll from the position P2 on the uppermost sealing portion side of a pair of the toilet paper rolls 30B and 30B closest to the upper sealing portion. In this position, when the upper sealing portion 41 is held by hand and pulled toward the upper sealing portion 41 side, since the inside of the exterior film 2 of the unsealing start portion 61 is a space, it can be easily pushed with a finger.

Each perforation 62*a* constituting the outlet forming portion 62 is located on the toilet paper roll group in each row arranged in two rows. The width L6 of the outlet forming portion 62 is 0.5 to 1.2 times, preferably 0.7 to 1.1 times the diameter L2 of the toilet paper roll. When the width L6 of the outlet forming portion 62 is 0.5 to 1.2 times the diameter L2 of the toilet paper roll, the take-out property becomes particularly improved when the diameter of the toilet paper roll 30 is small. The length L7 of the outlet forming portion 62 is set to the length to at least a paper tube of a pair of the toilet paper rolls 30C and 30C, which is close to the upper sealing portion next to a pair of the toilet paper rolls 30B and 30B (second closest to the upper sealing portion). With this length, the toilet paper roll 30 can be easily taken out. More preferably, the length is 1.3 to 3.8 times the diameter L2 of the toilet paper roll.

Conversely, if the length L7 of the outlet forming portion 62 is excessively long and extends from the upper sealing side of the package 1 toward the lower sealing side to the central position of the package 1, in the arrangement of the toilet paper roll 30 in the package 1, the risk of unintended tearing of the perforations increases during transportation or at the time of carrying with the finger hole.

Here, the toilet paper roll 30 according to the package 1 is individually wrapped with the resin film 50, and the individual wrapping mode of the toilet paper roll with the resin film 50 may be a general individual wrapping of toilet paper rolls, that is a wrapping mode in which the resin film is deformed and adhered in the shape of a toilet paper roll. Since individually wrapped toilet paper rolls 30Y and unwrapped toilet paper rolls 30X differ from each other in only the presence or absence of a space in the core, there is substantially no difference in outer dimensions. Note that, individual wrapping may be merely wrapping the toilet paper roll with the resin film 50, but it is desirable that the toilet paper roll be individually packaged so as to be sealed by an adhesive or fusion, such as a caramel package as shown in FIG. 2(B).

Examples of the resin film 50 for individual packaging include a polypropylene film and a polyethylene film. Further, the thickness is desirably 15 to 30 μm.

Second Embodiment

Figure 4:
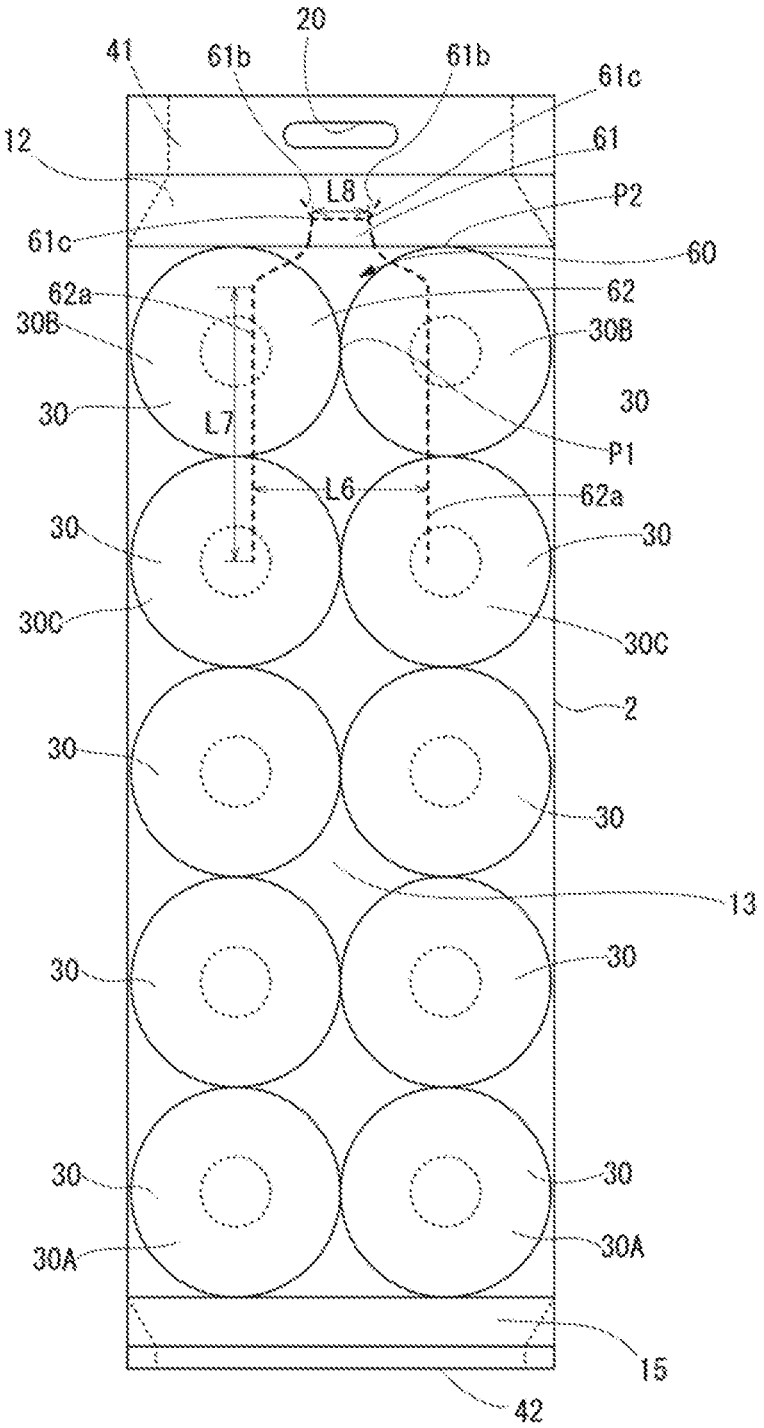
FIG. 4 is a front view for explaining an unsealing portion according to a second embodiment.

Next, a second embodiment will be described with reference to FIG. 4. The second embodiment differs from the first embodiment in the shape of an unsealing start portion and the shape of an unsealing start auxiliary perforation. Others are the same as in the first embodiment.

An unsealing start portion 61 in a package 1 of the present embodiment has a trapezoidal top shape in which perforations are arranged such that the upper sealing side is located on the top side. Each upper end portion 61*c* at the trapezoidal top may be chamfered. The length L8 of an upper bottom portion in the unsealing start portion 61 is desirably 20 to 63 mm.

Unsealing start auxiliary perforations 61*b* in the present embodiment is a pair of two perforations extending from the upper end portions 61*c* of the trapezoidal top to the upper sealing side. The length is the same as in the first embodiment. It is desirable that the two unsealing auxiliary perforations 61*b* and 61*b* be arranged such that they are gradually separated from each other, in particular, as they approach the upper sealing portion.

In the unsealing start portion of the second embodiment, similarly to the first embodiment, unsealing can be easily started by pushing and inserting a finger.

REFERENCE SIGNS LIST

1 package
2 exterior film
2E side portion of exterior film
11 gusset portion
12 top surface
13 front surface
14 back surface
15 bottom surface
20 finger hole
30 toilet paper roll
30A toilet paper roll closest to lower sealing portion
30B toilet paper roll closest to upper sealing portion
30C toilet paper roll second closest to upper sealing portion
30X toilet paper roll that is not individually wrapped
30Y toilet paper roll that is individually wrapped
31 peripheral surface of toilet paper roll
32 end surface of toilet paper roll
41 upper sealing portion
42 lower sealing portion
50 resin film
60 unsealing portion
61 unsealing start portion
61*a* end of unsealing start portion
61*b* unsealing start auxiliary perforation
61*c* upper end of trapezoidal top
62 outlet forming portion
62*a* perforation in outlet forming portion
P1 adjacent position of a pair of toilet paper rolls 30B closest to upper sealing portion
P2 position on uppermost sealing portion side of a pair of toilet paper rolls 30B closest to upper sealing portion
L1 core diameter
L2 diameter of toilet paper roll
L3 width of toilet paper roll
L4 width of unsealing start portion
L5 length of unsealing start portion
L6 width of outlet forming portion
L7 length of outlet forming portion
L8 length of upper bottom portion at unsealing start portion

The invention claimed is:

1. A toilet paper roll packaging system comprising:

a plurality of toilet paper rolls individually wrapped with a resin film, each of said plurality of toilet paper rolls having two end surfaces and a peripheral surface;

an exterior film sealed to form a gusseted package having an upper sealing portion, a lower sealing portion, a front surface, a back surface, a top surface, a bottom surface, a first side surface and a second side surface;

wherein the plurality of toilet paper rolls are arranged in two rows within said gusseted package with one of said two end surfaces of each of said plurality of toilet paper rolls facing the front surface of said gusseted package, the other of said two end surfaces of each of said plurality of toilet paper rolls facing the back surface of said gusseted package, and the peripheral surfaces of said plurality of toilet paper rolls abutting each other and at least one of said top surface, said bottom surface, said first side surface, and said second side surface of the gusseted package;

wherein said gusseted package includes an unsealing portion located below said upper sealing portion and extending from the top surface onto the front surface of said gusseted package, said unsealing portion defined by a plurality of lines of perforations in said exterior film that allows the gusseted package to be opened and one or more of the plurality of toilet paper rolls to be removed, wherein said unsealing portion includes an unsealing start portion with a U-shaped or substantially V-shaped line of perforations having a first end and a second end each oriented away from said upper sealing portion, and a belt-shaped outlet forming portion that is wider than the unsealing start portion and is formed by a pair of perforated lines that extend from one of the first and second ends of the perforations forming the unsealing start portion and toward the lower sealing portion;

wherein the unsealing start portion further comprises an unsealing start auxiliary perforated line extending from the U-shaped or substantially V-shaped line of perforations toward the upper sealing portion;

wherein each perforated line forming said belt-shaped outlet forming portion is located over one of said two end surfaces of at least one of said plurality of toilet paper rolls in a row of toilet paper rolls; and wherein said belt-shaped outlet forming portion has a width of 0.5 to 1.2 times the diameter of one of said plurality of toilet paper rolls.

2. A toilet paper roll packaging system, comprising:

a plurality of toilet paper rolls individually wrapped with a resin film, each of said plurality of toilet paper rolls having two end surfaces and a peripheral surface;

an exterior film sealed to form a gusseted package having an upper sealing portion, a lower sealing portion, a front surface, a back surface, a top surface, a bottom surface, a first side surface and a second side surface;

wherein the plurality of toilet paper rolls are arranged in two rows within said gusseted package with one of said two end surfaces of each of said plurality of toilet paper rolls facing the front surface of said gusseted package, the other of said two end surfaces of each of said plurality of toilet paper rolls facing the back surface of said gusseted package, and the peripheral surfaces of said plurality of toilet paper rolls abutting each other and at least one of said top surface, said bottom surface, said first side surface, and said second side surface of the gusseted;

wherein said gusseted package includes an unsealing portion located below said upper sealing portion and extending from the top surface onto the front surface of said gusseted package, said unsealing portion defined by a plurality of lines of perforations in said exterior film that allows the gusseted package to be opened and one or more of the plurality of toilet paper rolls to be removed, wherein said unsealing portion includes a generally trapezoidal unsealing start portion defined by a perforated top line ending in a first top corner and a second top corner, a first perforated side line extending between said first corner and a third corner, a second perforated side line extending between said second corner and a fourth corner, and a line between said third and fourth corners, and a belt-shaped outlet forming portion that is wider than the unsealing start portion and is formed by a pair of perforated lines each one extending from one of the third and fourth corners of the sealing start portion and toward the lower sealing portion;

wherein the unsealing start portion further comprises a pair of unsealing start auxiliary perforated lines, each unsealing start auxiliary perforated line extending from one of said first and second corners of said unsealing start portion and toward the upper sealing portion of said gusseted package;

wherein each perforated line forming said outlet forming portion is located over an end surface of at least one of said plurality of toilet paper rolls in a row of toilet paper rolls; and wherein said belt-shaped outlet forming portion has a width of 0.5 to 1.2 times the diameter of one of said plurality of toilet paper rolls.

* * * * *